United States Patent [19]

Wojcinski et al.

[11] Patent Number: 5,040,802

[45] Date of Patent: Aug. 20, 1991

[54] BACKSTOP FRAME

[76] Inventors: Allan S. Wojcinski, Bonifat Iusstrasse 88; Jürgen M. Hansen, Oberlöricker Strasse 371, both of D-4000 Dusseldorf 11, Fed. Rep. of Germany

[21] Appl. No.: 257,804

[22] Filed: Oct. 6, 1988

[30] Foreign Application Priority Data

Oct. 7, 1987 [DE] Fed. Rep. of Germany ..... 3733926

[51] Int. Cl.[5] ..... F41J 1/12

[52] U.S. Cl. ..... 273/410

[58] Field of Search ..... 273/404, 410; 210/498; 55/508

[56] References Cited

U.S. PATENT DOCUMENTS

| | | | |
|---|---|---|---|
| 1,641,670 | 9/1927 | French | 210/498 X |
| 3,398,959 | 8/1968 | Sanzare | 273/404 X |
| 4,458,901 | 7/1984 | Wojcinski | 273/410 |
| 4,597,784 | 7/1986 | Albrecht et al. | 55/508 X |
| 4,744,568 | 5/1988 | Bernahl et al. | 273/404 |

*Primary Examiner*—Paul E. Shapiro

*Attorney, Agent, or Firm*—Anthony A. O'Brien

[57] ABSTRACT

A backstop frame for intercepting projectiles is disclosed as including a holding plate having a series of parallel slots in which a series of lamellas are mounted, fasteners, secured the plate to a supporting structure and connectors join the lamellas to the plate.

27 Claims, 7 Drawing Sheets

14'
14"
13'
13"
14'
14"
B
B
A
A
A
A
B
B
1
2
3
4
5
6
7
8
9
10
11
15
α
II
II 1
10
11
12
20
III 10
11
2

20
11
10
3
9
5
2
8
4
6
7
α
VI
V

BACKSTOP FRAME

The invention relates to a back stop frame for projectile intercepting lamellas in a backstop assembly.

W. German Patent 31 31 228 discloses a backstop assembly comprizing a series of lamellas consisting of a hard rubber material which are disposed behind a target plane in such a manner that the individual lamellas of the assembly extend in a parallel spaced relationship at an angle to said target plane.

The object of the invention is to provide a backstop frame for a backstop assembly which permits the backstop to be installed in a shooting range and to be serviced in a simple and unproblematic manner.

The essential advantage of the invention resides in the fact that the inventive backstop frame holding the lamellas allows the handling and manipulations required for installing and servicing a backstop to be greatly accelerated and simplified, allowing to realize substantial savings. For example, the servicing of a backstop assembly comprising the inventive backstop frame merely requires the lamellas suspended in the frame that need to be replaced to be slightly raised, the withdrawal of the associated retaining bolts from the lamella edge portions projecting beyond the top of the backstop frame, and a downward removal of the lamellas from the backstop frame. New lamellas may be put in place with equal ease by moving them from below into the inventive backstop frame, inserting the retaining bolts into the lamella portions projecting upwardly beyond the backstop frame, and by then lowering the lamellas until the retaining bolts rest on the backstop frame. Advantageously, the aforesaid manipulations are readily executed by any unskilled person.

Another advantage of the invention resides in the fact that in installations such as sport shooting ranges, where in firing practice the weapons are aimed at a bank of sand, the provision of backstops only behind the targets will result in the projectiles being intercepted behind the targets and being prevented from penetrating into the sand. This way, contamination of the sand by lead particles or lead dust will be prevented, obviating expensive sand cleaning operations.

In target practice using stationary targets before a common backstop it is commonplace for the rubber lamellas or rubber plates etc. positioned behind the targets to quickly get perforated by the projectiles so that they have to be replaced right away. Using the inventive backstop frame, it is easy to provide additional small backstops behind the stationary targets and before the lamellas or plates so that the lamellas or plates may be protected against perforation. In this way, costs can be saved, because the lamellas or plates must be replaced at relative long intervalls.

Stated in general, the use of the inventive backstop frame now allows additional small backstop assemblies to be provided in the target area in front of any existing backstops so as to protect portions of existing backstop assemblies behind the targets which tend to get perforated rapidly.

This way, expensive replacement of elements of existing backstop assemblies can be avoided. The only measure necessary is to install and service the additional backstops in the described simple manner.

Another essential advantage resides in the fact that the inventive backstop frame may be manufactured in a relatively simple and cost-effective manner using wood, rubber or plastics. In accordance with a particularly advantageous development of the invention, the backstop frame may be assembled from at least three components, i.e. two outer components and one intermediate component, with both outer components being injection molded of a plastics material in a single mold. This will greatly reduce manufacturing costs. By providing serveral intermediate components—also capable of being injection molded of a plastics material in a single mold—the backstop or the backstop frame may be set up to have any desired width.

The invention and developments thereof will now be explained in greater detail under reference to the attached drawings.

Figure 1:
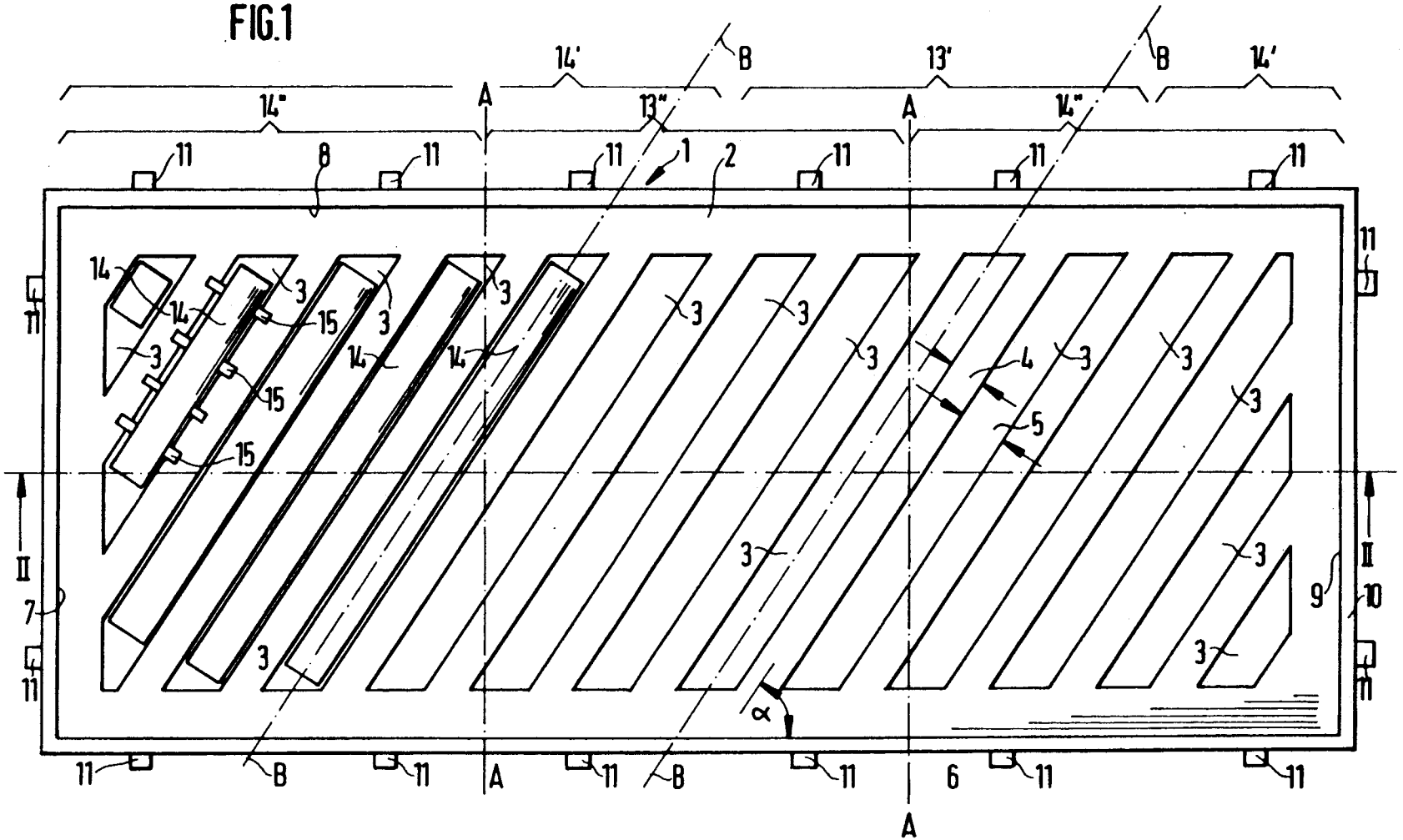
FIGS. 1 to 3 show a first embodiment of the present backstop frame.

FIG. 1 generally shows at 1 a first embodiment of the inventive backstop frame. This backstop frame 1 essentially consists of a holding device in the form of a plate 2 or the like having therein parallel slots 3. Slots 3 have a predetermined width 5 and are separated by predetermined distances 4. The widths 5 of slots 3 depend on the thickness of lamellas 14 to be introduced. These thicknesses in turn depend on the calibers of the weapons used on the range. For example, lamellas made of rubber may be 10 mm or 20 to 24 mm thick. For accepting greater calibers, the lamellas may be assembled from a plurality of individual lamellas. For installation in a backstop assembly, plate 2 is placed in a horizontal position and is oriented with its front longitudinal edge 6 in parallel with the target plane (not shown). Once so oriented, plate 2 has its slots 3 extending at an angle to the target plane. For example, the longitudinal direction of slots 3 may be oriented at an angle $\alpha$ to the target plane which preferably is about 60°.

Plate 2 may be in one piece or may be assembled of a plurality of individual plate components. In a particularly advantageous manner, plate 2 is made in one piece of a plastics material by an injection molding operation. It is contemplated, however, that plate 2 is made in one piece of wood or rubber, for example, or assembled from a plurality of wood or plastic parts.

Figure 2:
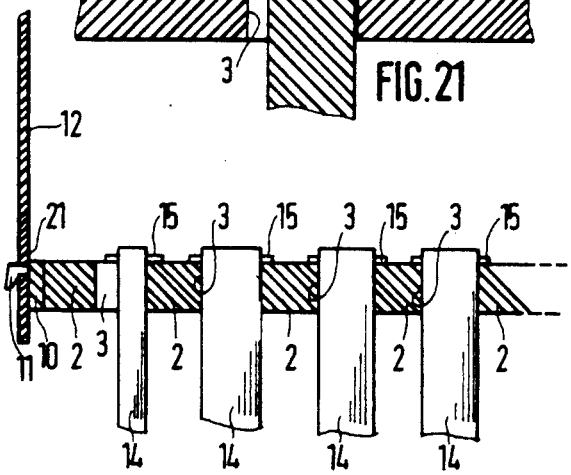

Along edges 6 to 9, plate 2 preferably has a reinforcing frame 10 attached thereto which surrounds plate 2. If made of a plastics material, reinforcing frame 10 may be injection molded integral with plate 2 in a single mold. At the outer surfaces of the reinforcing frame, fastening means 11 are provided which allow backstop frame 1 to be mounted in a backstop assembly in such a manner that plate 2 and slots 3 assume the orientations described above. Preferably, a plurality of fastening means are equally provided along each one of edges 6 to 9. Also preferably, fastening means 11 comprise—in the manner shown in FIG. 2—downwardly open hook-like members provided to engage suitable supporting elements of a frame stand or of rubber material stripes 12 suspended from a ceiling (FIG. 2). Fastening means 11 preferably are injection molded integral with reinforcing frame 10 in a single mold. It is contemplated to omit reinforcing frame 10 altogether and to provide fastening means 11 directly on plate 2.

For as cost-effective and inexpensive a fabrication of plate 2 (and possibly of reinforcing frame 10 and fastening means 11 as well) as possible, it is made of a plastics material such as polyurethane, and the inventive backstop frame 1 may conveniently be assembled of a plurality of indivdual components. In accordance with this concept, each backstop frame 1 comprises at least one middle component 13' or 13'' and two other components 14', 14''. It is particularly important that outer components 14', 14'', each of which is attached to one side of middle component 13' or 13'', are identical in shape and thus may be manufactured in a single mold by the same injection molding operation. It is contemplated also to provide a plurality of middle components 13' or 13'' between two outer components. Preferably, intermediate components 13' and outer components 14' are lined up along a line B—B extending along the center of a slot 3. Any desired fastening means 20 may be used to connect the components with each other. In the manner shown, lines A—A along which components 13'', 14'' are lined up with each other may also be perpendicular to front wall 6.

Figure 3:
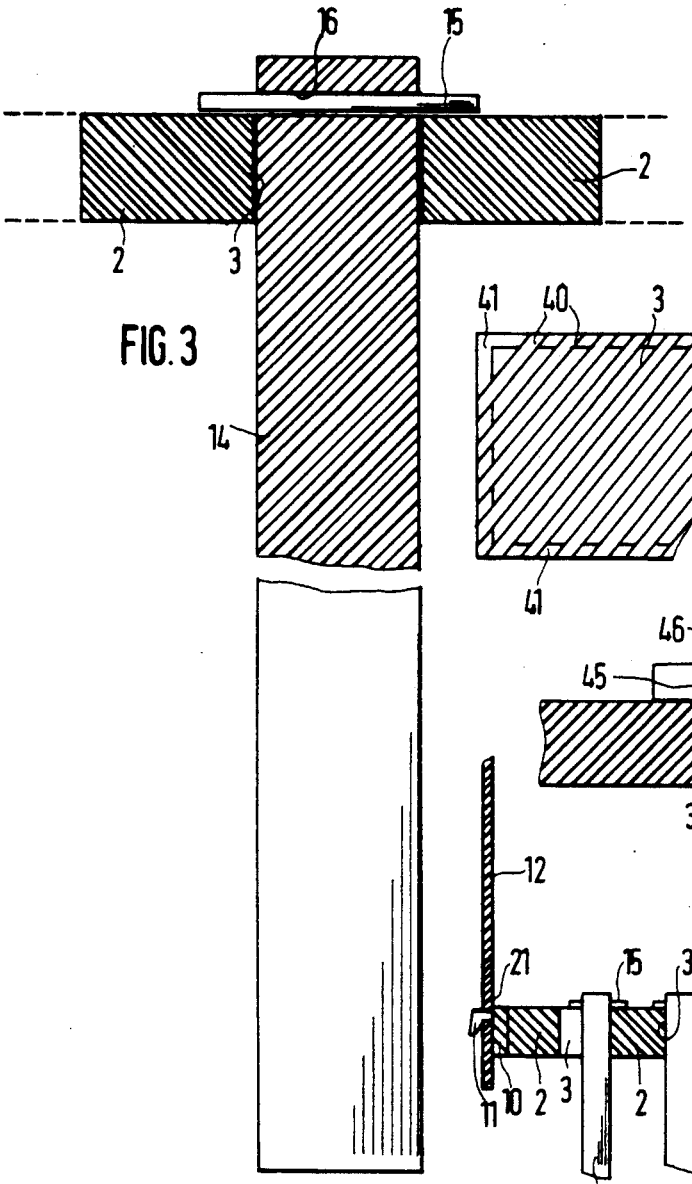

FIG. 2, a partial section along line II—II of FIG. 1, shows the manner of introducing the individual lamellas 14 in slots 3 and of securing them to backstop frame 1. Each lamella 14 is in the form of a slot having a thickness somewhat smaller than the width of a corresponding slot 3 and having a length somewhat smaller than the length of a corresponding slot 3 so as to ensure that each lamella readily be introduced in a corresponding slot 3. As shown particularly in FIGS. 1 and 3, the top end portion of each lamella 14 has spaced holes 16 extending therethrough which are arranged in parallel with end edge 17 of lamella 14, with each hole 16 intended to receive a pin or bolt 15 in a manner such that its ends project from the surfaces of the lamella 14. The length of each bolt 15 is dimensioned to be greater than the width of each slot 3. This measure ensures that each bolt 15 may by both its end portions engage the upper edge portions of slots 3, so that lamellas 14 will be retained in backstop frame 1. Preferably, a lamella 14 is introduced in backstop frame 1 in such a manner that a person moves it into a slot 3 from below to a heigth that its top end portion extends beyond slot 3 at the top of backstop frame 1. For securing lamellas 14 in place, bolts 15 are inserted in holes 16 of the projecting end portion. Thereafter, lamella 14 is lowered until the end portions of bolts 15 rest on the edge portions of the corresponding slot 3.

Material strips 12 (FIG. 2), which are provided to hold panel 2 and are fastened at one end thereof to the ceiling or other structure of a shooting range, conveniently have therethrough in the area of their other ends holes 21 to receive fastening members 11 in hook fashion. In the event these fastening means 11 are downwardly open hook-shaped members, as shown, holes 21 preferably are in the form of slots or key holes through which hook-shaped members 11 are introduced in the mounting operation. It is noted that any other fastening elements 11 may be used at this point. Also, strips 12 may comprise upwardly extending portions of a frame stand or the like supported on a floor.

Figure 5:
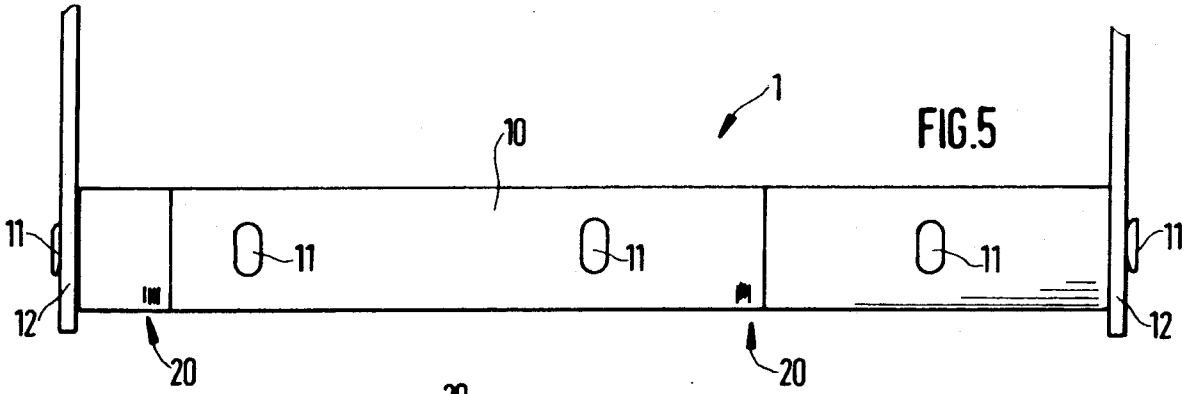
FIGS. 4 to 6 show various views of a backstop frame of a second embodiment of the present invention in its assembled condition.
Figure 6:
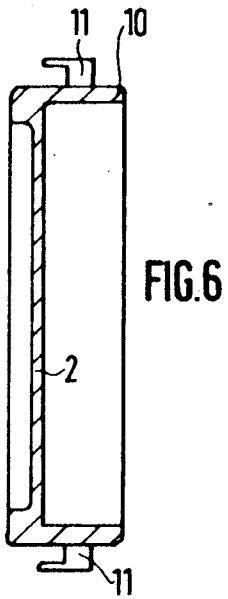
Figure 4:
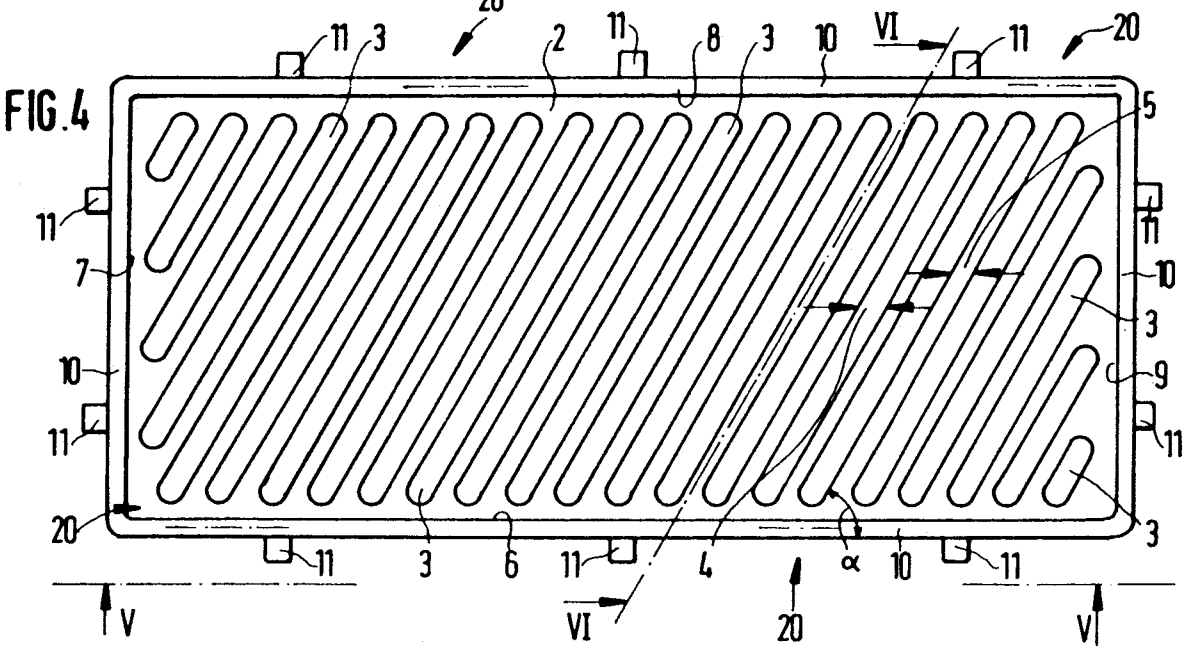

Any connection means desired—such as threaded bolts and nuts—may be used for interconnecting components 13', 14' or 13'', 14'', respectively. In the following, preferred connecting means 20 (FIG. 5) will be illustrated which enable the components to be interconnected in a particularly simple, rapid and stable manner.

In the manner shown in FIGS. 7, 11, 16 and 17, connecting means 20 preferably comprise at least one transversely resilient locking member 22 having a locking nose 24 and a corresponding receiving pocket 23 having a locking opening 25 to receive locking nose 24. Locking member 22 may be provided in any manner on a surface of component 13', 14' or 13'', 14'' to project therefrom, while pocket 23 is provided in the corresponding area of the adjacent component. Both locking member 22 and receiving pocket 23 are provided in the area of an outer edge 6, 8 of the corresponding component in such a manner that, as two components are assembled, a locking member 22 of one component engages the receiving pocket 23 of the adjacent component to get locking nose 24, which projects towards one side of locking member 22, to snap into a locking opening 25 in a corresponding inner surface of the associated receiving pocket 23. Each locking member 22 preferably comprises a block divided into two portions 27, 28 by means of a slot 26 extending in the longitudinal direction of locking member 22. By providing this slot 26, one portion 24 of the block may resiliently be urged towards the other portion 27 of the block (with slot 26 being narrowed in the process) as locking member 22 is being pushed into a associated receiving pocket 23. In this way, locking nose 24 on a member 28 may be introduced resiliently into its associated receiving pocket 23 to resiliently move outwardly and to provide the locking effect in hole 25. In order to facilitate the introduction of locking nose 24 into the receiving pocket, locking nose 24 conveniently is provided with a camming ramp portion 29. In order to obtain a stable interconnection of all components, there preferably are provided above a locking member 22 a recess 30 (or a projection 31 complementary to recess 30) and above a receiving pocket 23 a projection 31 (or a complementary recess 30). As adjacent components are being attached to each other, each projection 31 will enter an associated recess 30.

Figures 7, 8, 9, 10, 11, 12, 13, 14, 15:
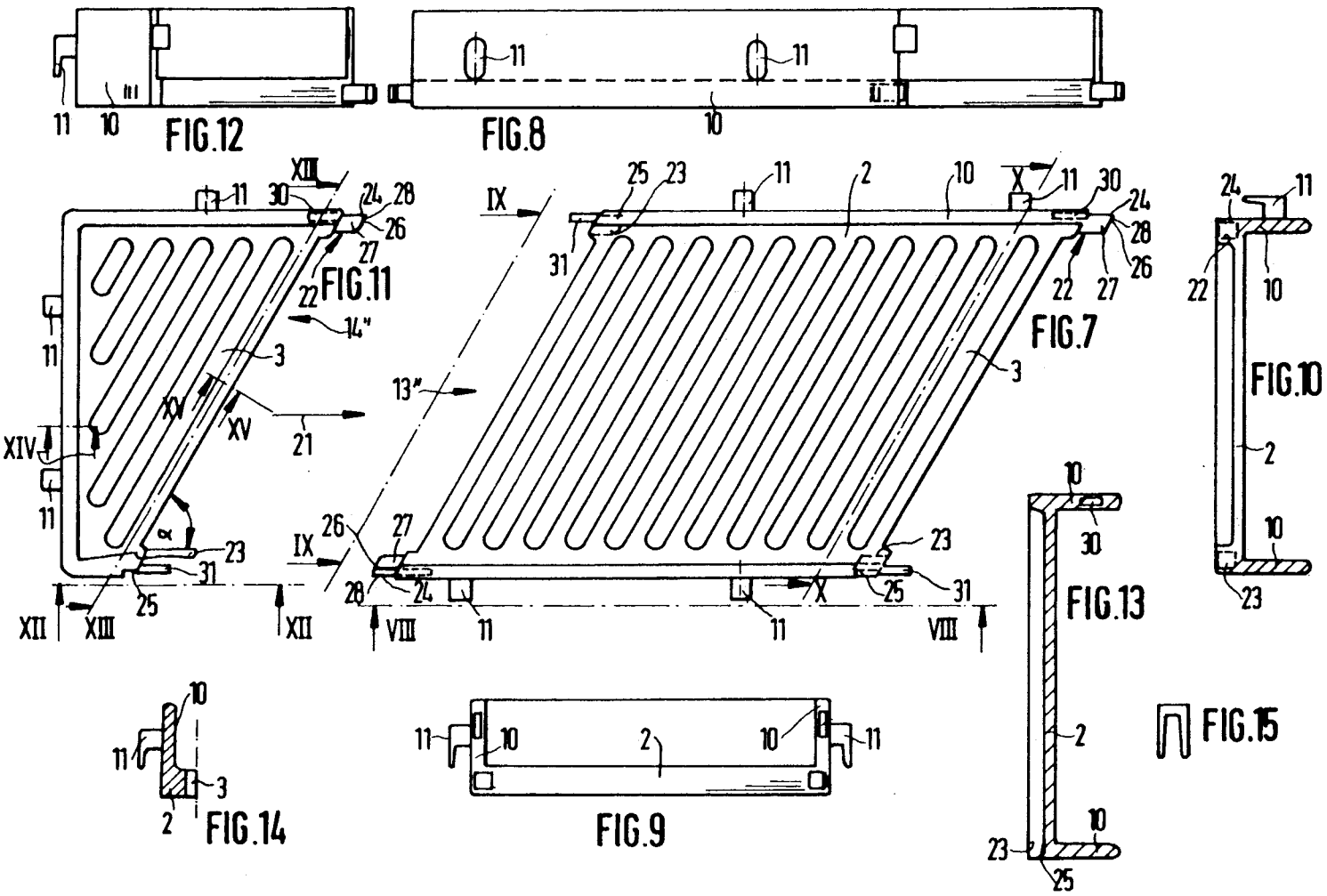
FIGS. 7 to 10 show various views of a intermediate component of a backstop frame assembly as shown in FIG. 4.
FIGS. 11 to 13 show various views of an outer component of a backstop frame as shown in FIG. 4.
FIGS. 14 and 15 show sections along lines XIV—XIV and XV—XV, respectively, of FIGS. 7 and 11.
Figures 16, 17, 18, 19:
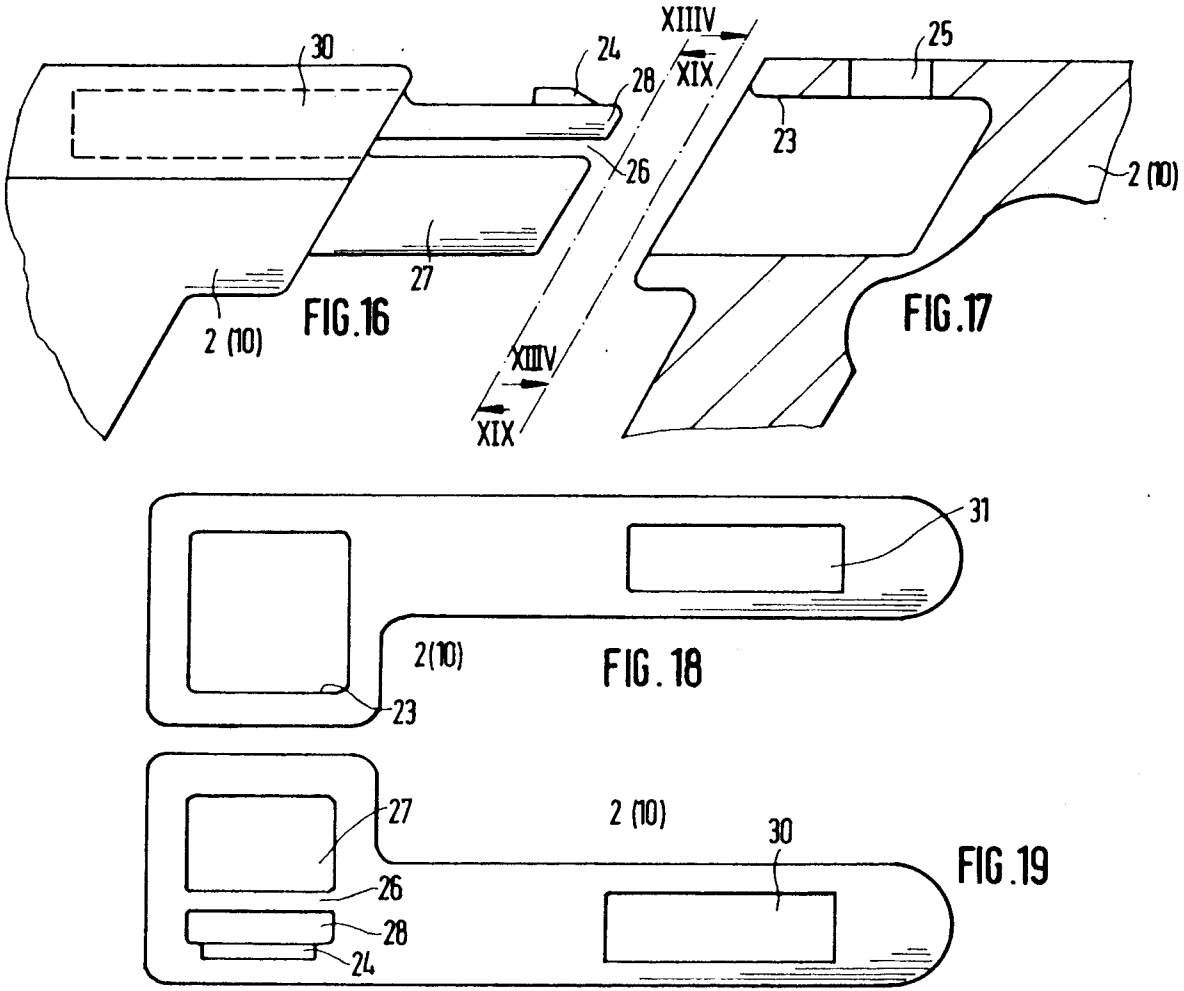

Plate 2 may be designed for enhanced rigidity and for materials savings at the same time by configuring the spacer portions between two slots 3 (as shown in FIG. 15) to have a U-shaped cross section comprising two spaced outer walls and a transverse top wall connecting the outer walls.

Figure 20:
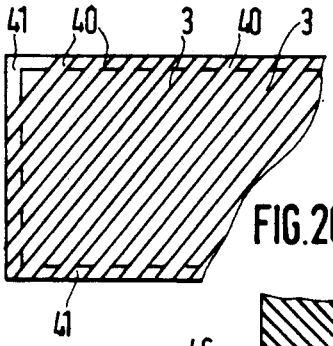
FIGS. 16 to 26 show additional developments of the invention.

In accordance with FIG. 20, and in particular if it is to be made of wood or plastics, the inventive backstop frame may be assembled of a plurality of strip members 40 placed in a spaced relationship on and secured parallel to each other to frame 41 (by screws, for example) so as to form plate 2 having the slots 3 therein. Frame 41 may likewise be made of wood or plastic.

Figure 21:
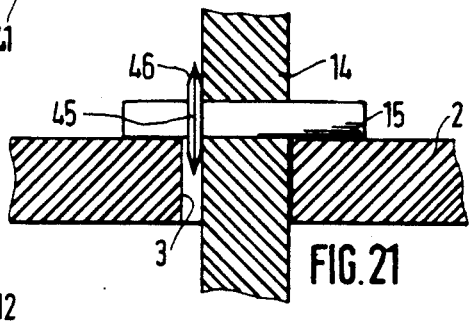

To prevent bolts 15 from being displaced lengthwise, they may be provided with collars or flanges 45 (FIG. 21) which are introduced in the space between a sidewall of a slot 3 and the adjacent surface of the corresponding lamella 14 as the latter is put in place. If bolt 15 is shifted in one or the other direction, flange 46 will abut one of the aforesaid sides of slot 3 or lamella 14. To facilitate introduction of flange 45 in the aforesaid space, the flange may be beveled along its periphery as shown at 46.

Figure 22:
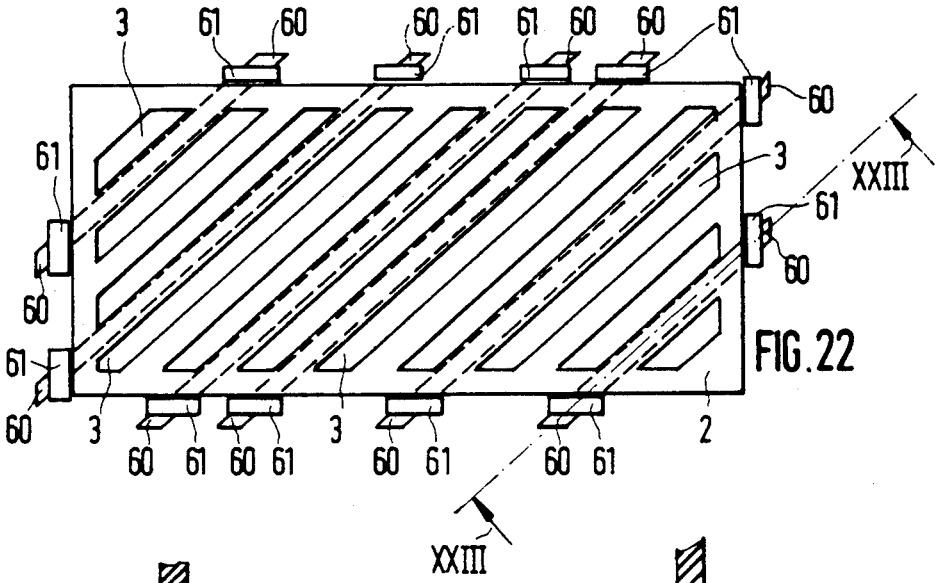
Figure 23:
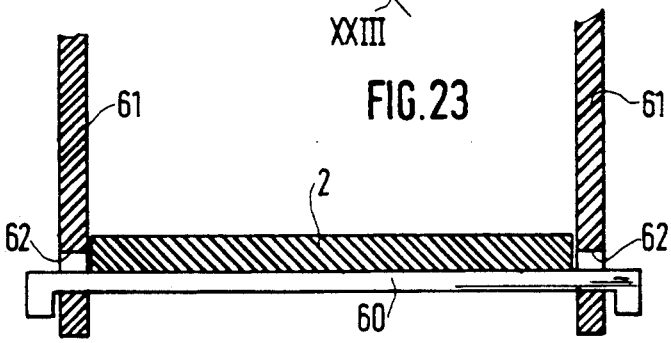

Under reference to FIG. 22, another embodiment of the inventive backstop frame will now be explained. This embodiment includes a plate 2 of rubber material. As a plate made of this rubber material is relatively flexible, supporting element 60 in strip shape are provided which preferably consist of rubber material as well and are disposed below spacing regions between two slots 3 in such a manner as to hold plate 2 in a approximately horizontal position. In the manner shown, the ends of supporting elements 60 project from the corresponding edges of plate 2. At the projecting end portions, there are connected the one ends of supporting elements 61 which have their other ends secured to the ceiling or other structure of the shooting range. Supporting elements 61 preferably are made of rubber. In the manner shown in FIG. 23, the aforesaid one ends of supporting elements 61 have openings 62 therethrough which receive the projecting end portions of supporting elements 60. In order to ensure that the projecting end portions of supporting elements 60 may project from openings 62, their free ends preferably are bent to overlie the edge of openings 62.

Figure 24:
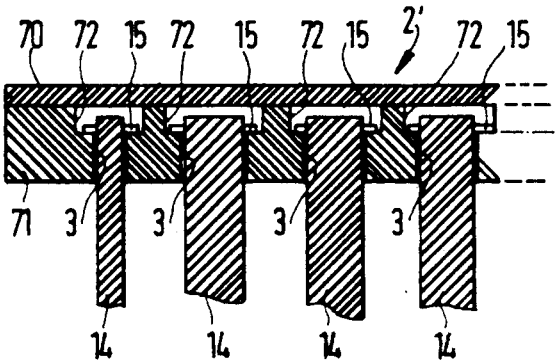

In accordance with FIG. 24, plate 2' may be configured to consist of an upper plate portion 4 or the like and of parallel guide rails secured below panel portion 71. Of these, two adjacent guide rails 71 define between them slot 3 and above that slot 3 an enlarged groove 72 to receive bolts 15 resting on the shoulder defined between slot 3 and groove 72. In this case, lamellas 14 are introduced in each slot 3 from one end thereof, with bolts 15 sliding on the aforesaid shoulder. Plate portion 70 and guide rails 71 may be made of wood, plastics or a rubber material, as stated above in connection with the other embodiments of the inventive backstop frame. Also, the embodiment shown in FIG. 24 may be divided into at least one middle or intermediate component and two out components.

Figure 26:
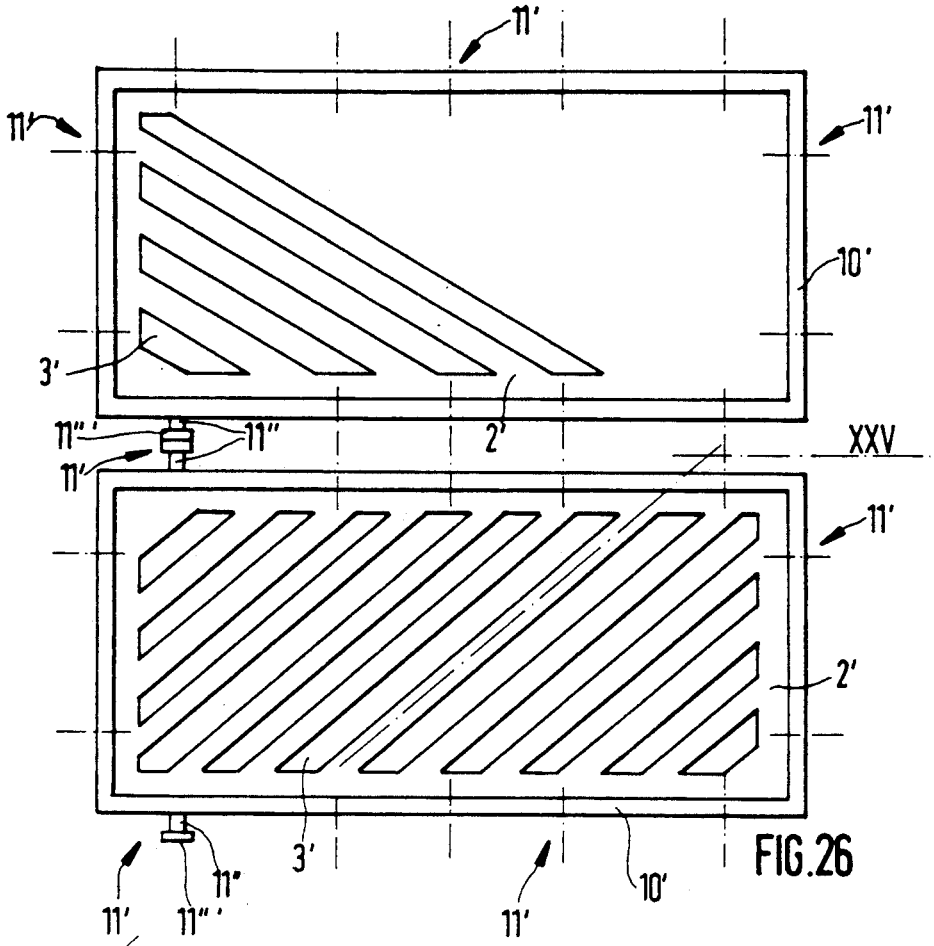
Figure 25:
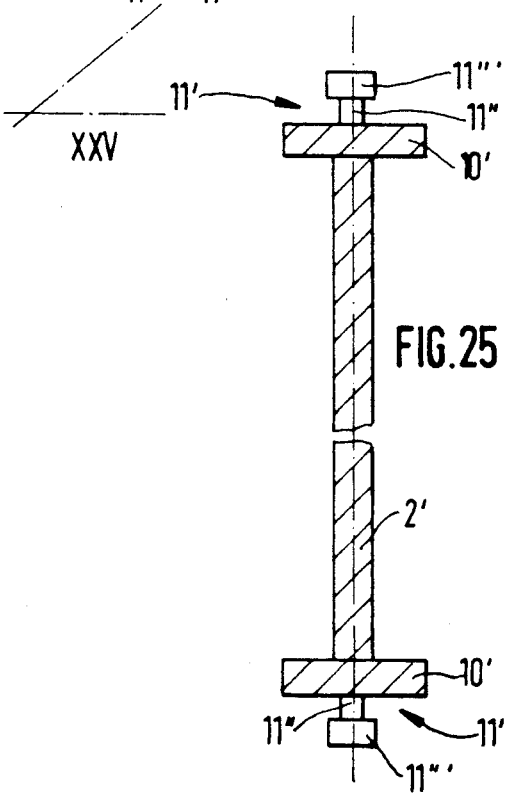

FIGS. 25 and 26 show a further development of the inventive backstop assembly in which plate 2' and frame 10' surrounding it are substantially symmetrical relative to a plane extending centrally through panel 2' and parallel to the surfaces thereof. In such an arrangement, frame 10' projects for equal distances from both sides in a direction perpendicular to plate 2'. By this measure, identical frames made in this form by means of a single injection mold, for example, may be arranged relative to each by simple inversion (FIG. 26) to create backstops having multi-row lamella assemblies, with the lamella rows extending at an angle opposite to each other and inclined to the target plane.

As shown in FIG. 25, it is convenient in this case to use fastening means 11' also extending in a symmetrical fashion relative to the aforesaid plane. Preferably, such fastening means 11' have the form of head portions 11''' spaced from frame 10' by rod portions 11'' extending through corresponding openings in supporting strips 12 which are suspended from a ceiling and may consist of rubber. In a manner known per se, these openings may be extended to form elongated slots to receive rod portions 11'' after the fastening operation. Preferably, plate 2' having slots 3' therein, frame 10' and fastening means 11' are fabricated of a plastics material in an injection molding operation.

Also, plate 2' of FIGS. 25 and 26 may consist of outer components and at least one intermediate component.

Plate 2' may be provided without a reinforcing frame. In that case, fastening means 11' would be attached to the panel edges directly.

Fastening means 11' may likewise be provided or secured in the manner described above on or to supporting elements of a stand or the like.

It is contemplated to use the inventive backstop frame to provide small-size backstops behind individual targets so as to intercept target-penetrating projectiles. In this case, there may be provided behind the targets and backstops a concrete wall which extends at an (exemplary) angle of 90° to the firing direction and is lined with rubber or the like sheets. Projectiles that miss a target will enter the rubber material in front of the wall, with the rubber material then catching projectiles the wall reflects and parts of that projectiles or concrete particles. An arrangement of this kind is relatively inexpensive as the backstops to be provided behind the targets may be relatively small.

We claim:

1. Backstop frame for intercepting projectiles and adapted to be carried by a supporting structure comprising a holding plate (2) having a plurality of slots (3) in spaced parallel relationship, fastening means (11) adapted to fasten said holding plate (2) to the supporting structure, a plurality of lamellas (14) being of smaller dimensions than said slots so that a single lamella (14) is disposed in a single slot(3), each lamella (14) having a predetermined thickness and each slot (3) being wider than the thickness of each corresponding lamella (14), and means securing each lamella (14) to said holding plate (2) to form a backstop frame assembly.

2. Backstop frame as in claim 1 wherein each lamella (14) has a top edge and a hole (16) parallel and adjacent said top edge, and said securing means includes a bolt (15) extending through said hole (16), said bolt (15) having a length greater than the width of its corresponding slot (3) so its opposite ends engage said holding plate (2).

3. Backstop frame as in claim 2 wherein each bolt (15) has a flange (45) disposed between a surface of a lamella (14) and a wall of a corresponding slot (3).

4. Backstop frame as in claim 3 wherein said flange (45) has a beveled periphery (46).

5. Backstop frame as in claim 3 wherein said flange (45) and said bolt (15) are made of a plastic material.

6. Backstop frame as in claim 3 wherein said flange (45) and said bolt (15) are made of steel.

7. Backstop frame as in claim 2 wherein a reinforcing frame (10) surrounds said holding plate (2).

8. Backstop frame as in claim 1 wherein said fastening means (11) includes a hook element and a strip (12) and wherein the strip (12) has a hole adapted to receive said hook element.

9. Backstop frame as in claim 8 wherein said strip (12) is made of a rubber material.

10. Backstop frame as in claim 1 wherein said fastening means includes a fastening element (60) having a hook element on its end, and a supporting strip (61) having a hole (62) through which said hook element projects.

11. Backstop frame as in claim 10 wherein said fastening element (60) is made of a rubber material.

12. Backstop frame as in claim 11 wherein said supporting strip (61) is made of a rubber material.

13. Backstop frame as in claim 1 wherein said holding plate (2) is rectangular shape having a pair of spaced longitudinal edges (6 and 8), and said slots (3) extend at an angle to said longitudinal edges.

14. Backstop frame as in claim 13 wherein said angle is an angel of 30 degrees.

15. Backstop frame as claimed in claim 13 wherein said holding plate (2) is disposed in a reinforcing frame (10) in a symmetrical arrangement relative to a plane centrally extending through said holding plate (2) and parallel to its surfaces.

16. Backstop frame as in claim 15, wherein said fastening means (11') is symmetrical relative to the said plane.

17. Backstop frame as in claim 16 wherein said fastening means having head portions (11''') and rod portions (11'') separating said head portions (11''') from said reinforcing frame (10').

18. Backstop frame as in claim 17, comprising by at least two backstop frames being arranged to form two rows of projectile intercepting lamellas (14) arranged with respect to each other at different orientation angles.

19. Backstop frame as in claim 1 wherein said holding plate (2) includes at least one middle component (13', 13'') and two equal outer components (14', 14''), and connecting means (20) carried by said components for connecting all the components together.

20. Backstop frame as in claim 19 wherein said connecting means (20) is adjacent the edge of said holding plate (2).

21. Backstop frame as in claim 20, characterized in that each said connecting means comprises on one component a locking member (22) which is transversely resilient and has a locking nose (24) and on the adjacent component a receiving pocket (23) and a locking hole (25) for said locking nose (24).

22. Backstop frame as in claim 21, characterized by said connecting means including a projection (31) and a complementary recess (30) adjacent said locking member (22) and receiving pocket (23) to interengage as two components are being attached to each other.

23. Backstop frame as in claim 22, characterized by middle component (13', 13'') and outer components (14', 14'') and said connecting means (20) are formed of a plastic material.

24. Backstop frame as in claim 22, characterized by outer components (14', 14'') being equally shaped and being adapted to be fabricated in a single injection mold.

25. Backstop frame as in claim 22, characterized by a plurality of middle components (14', 14'') being equally shaped and being adapted to be fabricated in a single injection mold.

26. Backstop frame as in claim 25, characterized by said holding plate (2) consisting of a material selected from a wood material, a plastic material or a rubber material.

27. Backstop frame as in claim 26, characterized by holding plate (2) being composed of individual parts.

* * * * *